United States Patent [19]

Carroll

[11] 4,211,402

[45] Jul. 8, 1980

[54] GAME AND EXERCISING DEVICE, METHOD OF EXERCISING, AND METHOD OF PLAYING A GAME

[76] Inventor: Kevin T. Carroll, 747 Marietta Ave., Lancaster, Pa. 17603

[21] Appl. No.: 870,878

[22] Filed: Jan. 20, 1978

[51] Int. Cl.[2] ..... A63B 21/28

[52] U.S. Cl. ..... 272/93; D21/198; 272/143; 273/1 R

[58] Field of Search ..... 272/67, 68, 116, 125, 272/93, 126; D34/5 K; 273/106 D, 106 R

[56] References Cited

U.S. PATENT DOCUMENTS

| | | | |
|---|---|---|---|
| D. 232,368 | 8/1974 | Shales | D34/5 K |
| 1,035,252 | 8/1912 | Smith | 272/93 |
| 3,068,003 | 12/1962 | Portman | 272/125 |
| 3,129,940 | 4/1964 | Lauro | D34/5 K |
| 3,349,621 | 10/1967 | Mullen | 272/68 X |
| 3,672,675 | 6/1972 | Morris | 273/106 R |
| 4,039,185 | 8/1977 | Rhodes | 272/68 |

FOREIGN PATENT DOCUMENTS

| | | | |
|---|---|---|---|
| 481571 | 8/1929 | Fed. Rep. of Germany | 272/116 |

*Primary Examiner*—Richard J. Johnson

*Attorney, Agent, or Firm*—Harding, Earley & Follmer

[57] ABSTRACT

A game and exercising device has a longitudinal substantially rigid body having a pair of ends with a pair of spaced and opposed handles at each end of the body. The handles lie in substantially the same plane and are rigidly fixed with respect to each other and the body. In a method for the joint exercising of two people one person grasps a pair of spaced handles fixedly connected to a pair of opposed spaced handles and a second person grasps the opposed spaced handles and each person exerts a force on the connected handles in conjunction with or opposition to the force exerted by the other person. In a method of playing a game one person grasps a pair of spaced handles fixedly connected to a pair of opposed spaced handles and a second person facing the first person grasps the opposed spaced handles. Each person exerts a force on the connected handles in an attempt to force the other person to move.

16 Claims, 9 Drawing Figures

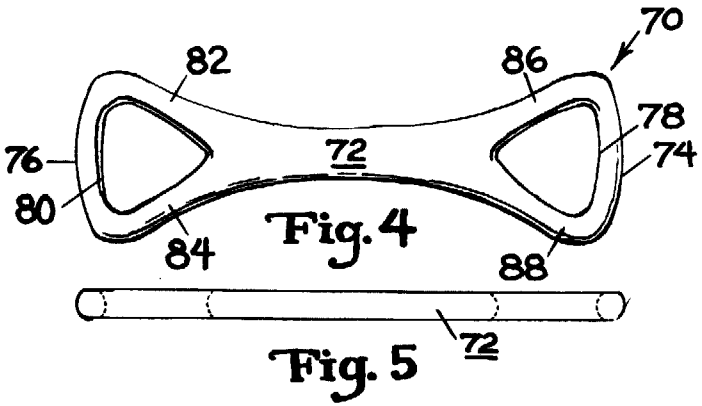
Fig. 4
Fig. 5
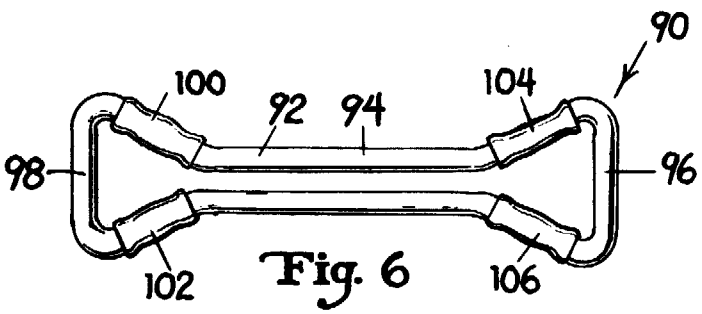
Fig. 6
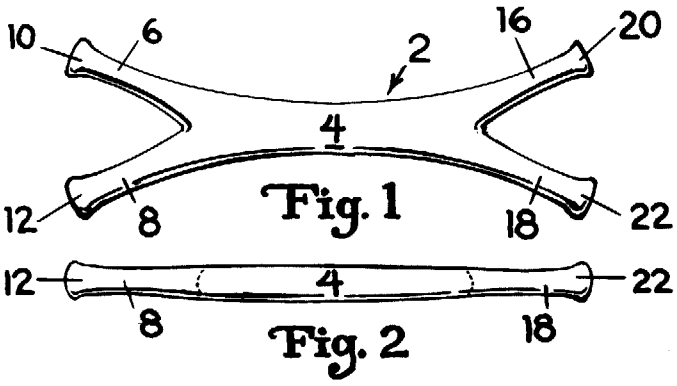
Fig. 1
Fig. 2
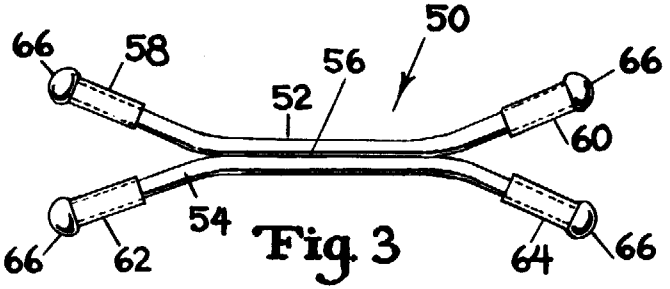
Fig. 3

GAME AND EXERCISING DEVICE, METHOD OF EXERCISING, AND METHOD OF PLAYING A GAME

BACKGROUND OF THE INVENTION

Single handed exercise devices for the use by one person are known to the art as is exemplified by U.S. Pat. No. 3,884,464. It is also known to have devices with pairs of opposed handles for use by a single person wherein some of the handles are movable with respect to the other handles as illustrated by U.S. Pat. No. 2,643,123 in which one of a pair of opposed handlebars is pivoted, and U.S. Pat. No. 3,349,621 in which a pair of handlebars are pivotally connected. U.S. Pat. No. 4,039,185 discloses an Indian-wrestling device having a single handle for each of two persons who are to wrestle. U.S. Pat. No. 3,536,326 discloses an X-frame supporting elastic cables which are grasped by a single person and pushed and pulled to provide exercise.

This invention satisfies the need for a device with four handles which can be grasped by two opposed persons for the exercising of both of them. By virtue of exercising two people together each person stimulates the other person while receiving a dynamic full-body exercise which neither could achieve alone, since each person receives back more than he puts into the exercise session. Through responding to human movements each person gains more complete exercise in a well-rounded way than is possible when exercising alone. Strength, muscle tone, flexibility and development of arms, back and legs are achieved with each person providing a challenge to the other.

The invention also provides in addition to a two-handed-two person exercising device and method of exercising, a two-handed-two person game device and a method of playing a game, which while being played will also provide useful exercise. The prior art does not disclose the game aspects of the invention.

SUMMARY OF THE INVENTION

A game and exercising device has a longitudinal substantially rigid body having a pair of ends with a pair of spaced and opposed handles at each end of the body. The handles lie in substantially the same plane and are rigidly fixed with respect to each other and the body. In a method for the joint exercising of two people one person grasps a pair of spaced handles fixedly connected to a pair of opposed spaced handles and a second person grasps the opposed spaced handles and each person exerts a force on the connected handles in opposition to the force exerted by the other person, or in addition to the other person's force to further stretch the muscles of the other person. In a method of playing a game one person grasps a pair of spaced handles fixedly connected to a pair of opposed spaced handles and a second person facing the first person grasps the opposed spaced handles. Each person exerts a force on the connected handles in an attempt to force the other person to move out of his position.

Advantageously the game and exercising device of the invention has a generally X-shape. The body and handle means preferably are integral. To facilitate gripping and more comfort, the handles may have a resilient surface of, for example, rubber or a resilient plastic such as resilient polyvinyl chloride, polyethylene and polypropylene. It is advantageous to have the handles all equally spaced from the center of the body of the device. Typically the body may be formed of a pair of metal pipes welded together, or may be made of wood, or may be molded in metal or a rigid plastic, for example an acrylic resin such as methyl methacrylate a phenolic resin, polystyrene, polycarbonate or polyester resin and other rigid plastics all of which are disclosed in "Modern Plastics Encyclopedia", Vol. 54, No. 10A (77-78) which is incorporated herein by reference, or the like.

The ends of the body may be closed adjacent the handles to prevent the hands of the users from moving off the device longitudinally. A desirable form of body is one formed of a bar forming a closed loop. The term "bar" as used herein includes both solid and hollow bodies and is not intended to be limited to any particular cross-section.

BRIEF DESCRIPTION OF THE DRAWINGS

FIG. 1 is a plan view of a game and exercising device in accordance with the invention;

FIG. 2 is a side elevation of the device of FIG. 1;

FIG. 3 is a plan view of an alternative game and exercising device in accordance with the invention;

FIG. 4 is a plan view of an alternative game and exercising device in accordance with the invention;

FIG. 5 is a side elevation of the device of FIG. 4;

FIG. 6 is a plan view of an alternative game and exercising device in accordance with the invention;

DETAILED DESCRIPTION

Figure 7:
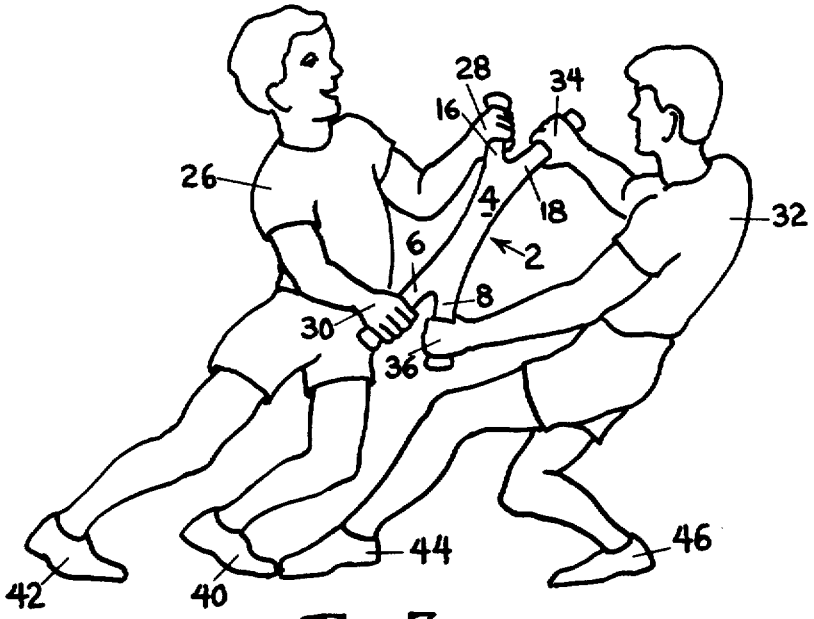
FIG. 7 is a side elevational view of two people standing and grasping opposite handles of the device of FIG. 1.

A game and exercising device 2 in accordance with the invention has a longitudinal substantially rigid body 4 having a generally X-shape. The body 4 has a pair of spaced and opposed handles 6 and 8 at one end. Knobs 10 and 12 integral with the body 4 and at the outer ends of handles 6 and 8 respectively are provided to prevent a hand from slipping off each of said handles 6 and 8. A pair of spaced and opposed handles 16 and 18 are at the other end of body 4 and similarly are provided with knobs 20 and 22 respectively to prevent a hand from slipping from each of said handles 16 and 18. All of the handles 6, 8, 16 and 18 lie in substantially the same plane, are integral with the body 4, and are equidistant from the center of the body 4. The device 2 may be made from any suitable material such as a metal, plastic or wood. Handles 6 and 8, and similarly handles 16 and 18, advantageously are spaced apart a sufficient distance such that the hands of a person grasping handles 6 and 16 do not touch the hands of a person grasping handles 8 and 18. The distance between handles 6 and 16 and between handles 8 and 18 is such that each set of handles may be grasped by the two hands of one person. It is perferred to have the centers of handles 6 and 16 in the range of from about 10 to about 30 inches apart and, of course, the same range is applicable to the distance between the centers of handles 8 and 18.

The use of the device 2 for exercising is illustrated in FIG. 7. As shown in FIG. 7, a man 26 is grasping the device 2 with his left hand 28 on handle 16 and his right hand 30 on handle 6. Similarly a man 32 facing man 26 has his right hand 34 grasping handle 18 and his left hand 36 grasping handle 8. Man 26 has his left foot 40 in an advanced position and his right foot 42 retracted. The man 32 has his left foot 44 in an advanced position opposite foot 40 and his right foot 46 in a retracted position. To carry out their exercising the men 26 and 32 exert forces to push, pull, twist, move upwardly and downwardly and to either side the device 2 either working in concert or against each other. For example, man 26 may be designated the leader who will determine the movement of the device 2 while the man 32 will simply provide varying forces resisting or aiding such movement. On the other hand the exercising may take the form of wrestling with one man attempting to overcome the movements of the other man.

Figure 8:
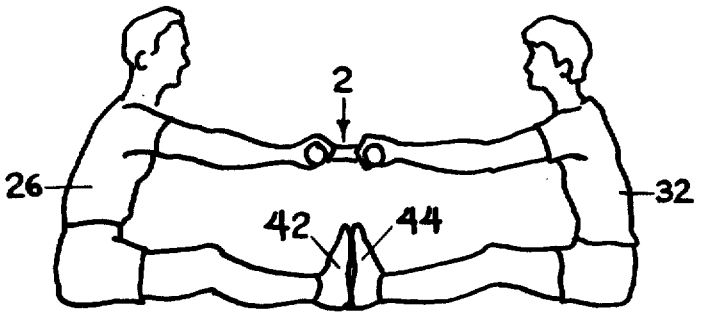
FIG. 8 is a side elevational view of two people sitting and grasping opposite handles of the device of FIG. 1.
Figure 9:
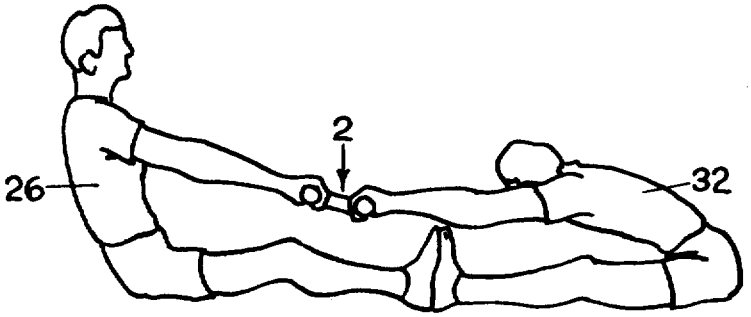
FIG. 9 is a side elevational view of the people of FIG. 8 exercising with the device of FIG. 1.

The position of the men 26 and 32 may be widely varied. As illustrated in FIG. 8 these men may be seated on a floor with the soles of their feet against each other, while carrying out exercising movements such as are described above. One such movement is illustrated in FIG. 9 where the men 26 and 32 are exercising cooperatively with the man 26 pulling the man 32 over into a doubled position to stretch the latters back and arm muscles.

It will be understood that the device 2 may be employed for exercising with the two exercising people in a wide variety of other positions such as, for example, kneeling, or with both people standing with one person facing the back of the other person.

An alternative game and exercising device 50 in accordance with the invention is shown in FIG. 3. The device 50 is formed with a pair of oppositely bent pipes 52 and 54 that are welded together as indicated at 56. Resilient hollow rubber handles 58 and 60 are telescoped over opposite ends of pipe 52. Similarly resilient hollow rubber handles 62 and 64 are telescoped over opposite ends of pipe 54. Each handle is provided with a knob 66 at its outer end. The device 50 is used in the same manner as the device 2.

As shown in FIG. 4, an alternative game and exercising device 70 has a longitudinal substantially rigid body 72 having enlarged opposed ends 74, 76 with openings 78 and 80 respectively therein. Body 72 has opposed handle portions 82 and 84 adjacent opening 80 and similarly has a pair of opposed handle portions 86 and 88 adjacent opening 78. With handle portions 82 and 86 grasped by one person and handle portions 84 and 88 grasped by another person, the device 70 may be used in the same manner as the device 2.

As shown in FIG. 6, an alternative game and exercising device 90 in accordance with the invention is formed from a rigid tubular member 92 that is formed into generally an X-shape to provide a continuous loop having a reduced central portion 94 and enlarged end portions 96 and 98. Opposed handles 100 and 102 are mounted on end 98 while opposed handles 104 and 106 are mounted on end 96. The device 90 may be used in the same manner as the device 2.

The carrying out of the method of the invention is also illustrated by the showings in FIGS. 7, 8 and 9. If the men 26 and 32 illustrated in FIG. 7 wish to play the game of the invention, they assume agreed positions and then exert force on the device 2 until one man is forced off his position. For example, with the men 26 and 32 in the positions illustrated in FIG. 7 with their left feet 40 and 44 opposite each other, a typical game would be for each man to exert force on the device 2 in an attempt to cause the other man to replace his left foot in a position different from the starting position. Similarly, the men 26 and 32 in the positions illustrated in FIG. 8 may play the game of the invention by exerting force on the device 2 with the winner being the man who moves the other man over onto his sides. These descriptions of playing the game are merely illustrative, it being obvious that they may be widely varied, the players assuming widely varying positions with an infinite number of predetermined movements being possible for determining the winner of the game. While the method of playing the game of the invention has been described with respect to the device 2, it will be clear that it can be played with any device of the invention such as the devices 50, 70 and 90. It will also be evident that both exercising and game playing can be carried out simultaneously.

The above described embodiment and methods of the invention are illustrative and are not intended to be limiting except as set forth in the following claims.

I claim:

1. A game and exercising device comprising:
a longitudinal body having a center portion and end portions,
said center portion extending along a longitudinal axis,
said body being substantially rigid for transmitting pushing, pulling, and turning forces, and
four handles,
a first pair of said four handles extending away from each end portion of the longitudinal body and extending away from said longitudinal axis in the same direction and the same degree,
a second pair of said four handles extending away from each end portion of the longitudinal body and extending away from said longitudinal axis in the same direction and degree and opposite to the direction and degree of said first pair of handles,
all of said handles being rigidly fixed with respect to each other and the body,
each handle being large enough to accommodate a hand, whereby a person can grasp a handle at each end of said longitudinal body.

2. A game and exercising device in accordance with claim 1 in which the handles are all equally spaced away from the center of the body, and each handle extends from said body at an angle of less than 90degrees and more than 10 degrees from said longitudinal axis.

3. A game and exercising device in accordance with claim 1 in which the body and handles are integral.

4. A game and exercising device in accordance with claim 1 in which the handles have a resilient surface.

5. A game and exercising device in accordance with claim 1 in which the body has a generally X-shape, and all handles lie in the same plane.

6. A game and exercising device in accordance with claim 1 in which the body is formed of a pair of pipes welded together.

7. A game and exercising device in accordance with claim 1 in which the body is a plastic body.

8. A game and exercising device in accordance with claim 1 in which the body has an opening at each end and the handle means are adjacent the openings whereby the hands of the users are prevented from moving off the device longitudinally.

9. A game and exercising device in accordance with claim 1 in which the body is formed of a bar forming a closed loop.

10. A game and exercising device for use by two people comprising:

a longitudinal substantially rigid body having a pair of opposed ends, and a pair of spaced and opposed handles at each end of the body and integral with the body, all of said handles being integral with the body and being equidistant from the center of the body, said handles lying in substantially the same plane, said body being generally X-shaped, said handles having a resilient surface, said body being formed of a pair of pipes connected together by a weld, whereby two opposed people can grasp the handles.

11. A method for the joint exercising of two people using a game and exercising device having a longitudinal body having a center portion and end portions, said center portion extending along a longitudinal axis, said body being substantially rigid for transmitting pushing, pulling, and turning forces, and four handles, a first pair of said four handles extending away from each end portion of the longitudinal body and extending away from said longitudinal axis in the same direction and the same degree, a second pair of said four handles extending away from each end portion of the longitudinal body and extending away from said longitudinal axis in the same direction and degree and opposite to the direction and degree of said first pair of handles, all of said handles being rigidly fixed with respect to each other and the body, each handle being large enough to accommodate a hand, whereby a person can grasp a handle at each end of said longitudinal body, said method comprising:

one person grasping said first pair of spaced handles with one handle being at each end of the longitudinal rigid body, a second person grasping said second pair of spaced handles at each end of the longitudinal rigid body, and each person exerting pushing, pulling and turning forces on the handles in opposition to or in addition to the force exerted by the other person, with said force being transmitted to the other person through said rigid body.

12. The method of claim 11 in which the two persons are both standing face to face.

13. The method of claim 11 in which the two persons are in a sitting position with the soles of their feet in contact.

14. The method of claim 11 with one person facing the back of the othr person.

15. A method of playing a game using a game and exercising device having a longitudinal body having a center portion and end portions, said center portion extending along a longitudinal axis, said body being substantially rigid for transmitting pushing, pulling, and turning forces, and four handles, a first pair of said four handles extending away from each end portion of the longitudinal body and extending away from said longitudinal axis in the same direction and thesame degree, a second pair of said four handles extending away from each end portion of the longitudinal body and extending away from said longitudinal axis in the same direction and degree and opposite to the direction and degree of said first pair of handles, all of said handles being rigidly fixed with respect to each other and the body, each handle being large enough to accommodate a hand, whereby a person can grasp a handle at each end of said longitudinal body, said method comprising one person grasping said first pair of spaced handles with one handle being at each end of the longitudinal rigid body, a second person facing the first person and grasping said second pair of spaced handles with one handle being at each end of the longitudinal rigid body, and each person exerting pushing, pulling and turning forces on the handles in an attempt to force the other person to change his position, the person who is first forced to change position being the loser of the game.

16. A method in accordance with claim 15 in which both persons are standing in place with the same foot forward and opposite the other persons forward foot prior to any force being exerted.

* * * * *